US005334033A

United States Patent [19]

Milan

[11] Patent Number: 5,334,033

[45] Date of Patent: Aug. 2, 1994

[54] MODULAR OUTLET STRIP

[76] Inventor: Henry Milan, 1709 Appleridge Ct., Rochester Hills, Mich. 48309

[21] Appl. No.: 144,048

[22] Filed: Oct. 27, 1993

Related U.S. Application Data

[63] Continuation of Ser. No. 918,241, Jul. 23, 1992, Pat. No. 5,292,257.

[51] Int. Cl.[5] ..... H01R 25/16

[52] U.S. Cl. ..... 439/214; 439/620

[58] Field of Search ..... 439/207, 209–211, 439/214, 216, 622, 652; 200/51.11

[56] References Cited

U.S. PATENT DOCUMENTS

| | | | |
|---|---|---|---|
| 1,990,176 | 2/1935 | Fried | 439/622 |
| 2,269,779 | 1/1942 | Morten | 439/216 |
| 2,307,230 | 1/1943 | Morten | 439/214 |
| 2,320,332 | 5/1943 | Morten | 439/209 |
| 2,453,314 | 11/1948 | Hammerly | 439/211 |
| 2,457,831 | 1/1949 | O'Brien | 439/214 |
| 2,640,125 | 5/1953 | Eggers | 439/622 |
| 2,952,829 | 9/1960 | Grohsgal | 439/214 |
| 4,085,996 | 4/1978 | Koslo | 439/652 |
| 4,659,161 | 4/1987 | Holcomb | 439/652 |
| 4,867,701 | 9/1989 | Wiand | 439/652 |
| 4,875,871 | 10/1989 | Booty, Sr. et al. | 439/210 |
| 4,909,749 | 3/1990 | Long | 439/346 |
| 5,071,367 | 12/1991 | Luu | 439/502 |

FOREIGN PATENT DOCUMENTS

| | | | |
|---|---|---|---|
| 914712 | 10/1946 | France | 439/209 |
| 591432 | 8/1947 | United Kingdom | 439/209 |
| 591664 | 8/1947 | United Kingdom | 439/209 |
| 2012497 | 7/1979 | United Kingdom | 439/207 |

*Primary Examiner*—Gary F. Paumen
*Attorney, Agent, or Firm*—Marshall & Melhorn

[57] ABSTRACT

A modular surge protector is provided where only the number and types of modules needed are purchased and connected together by quick connect means. Generally, the modular surge protector includes a power distribution module, which is connected to a source of line current and one or more power supply modules, which snap to each other by the use of the quick connect means. Each of the power supply modules will have at least one power supply outlet and may also have a modem surge protector.

19 Claims, 7 Drawing Sheets

MODULAR OUTLET STRIP

This application is a continuation of U.S. patent application Ser. No. 07/918,241 filed Jul. 23, 1992, now U.S. Pat. No. 5,292,257.

BACKGROUND OF THE INVENTION

1. Field of the Invention

The present invention deals with outlet strips, and more particularly, with an outlet strip which may be in the form of a surge protector of the type commonly used to protect sensitive electrically operated equipment from line current surges. Most particularly, the invention deals with a modular outlet strip or surge protector having several types of sections which are quickly connected and disconnected by virtue of "quick connect" means provided on the modules.

2. Description of the Prior Art

Electrically operated equipment, practically since its inception, has been subject to surges of current over the power lines to which it is connected. These current surges can be caused by naturally occurring phenomenon, such as lightning strikes during thunder storms, which induce power surges in the power lines, or by man-made causes, such as sudden variations in the power being output from a generating station due to failures of components or other generators going on- or off-line.

Some types of electrical equipment have been developed which are more sensitive to line current surges than other types. Equipment which is particularly sensitive is in the nature of television sets, stereos, answering machines, and more recently, computer equipment. Ever since the advent of this sensitive electronic equipment, those in the art have sought a convenient and economical way to protect such electrical equipment from power surges. Many-surge protectors are known in the prior art, and all operate by generally well-known principles, such as by capacitors connected between live and earth which discharge in the presence of a sudden surge of power and effectively short out that surge of power before it can reach the power supply cords plugged in to such surge protectors.

However, the outlet strips and surge protectors available in the prior art are generally of one type. They consist of a line cord with the surge protection, where used, connected across many outlets connected in parallel. Normally, the surge protectors have an on/off switch, an indicator light, and from six to ten receptacles. In many cases, only one or two receptacles are needed at a particular location, and the excess of receptacles provides for a bulky and inconvenient appliance.

Also, with the advent of computers with built-in telephone modems, a modem surge protector is many times needed in conjunction with a line current surge protector so that both the phone modem and the computer are protected from surges of current which may occur simultaneously. Modem surge protectors, in combination with line current surge protectors, have not been available until the time of the present invention. Thus, those skilled in the art have continued to search for solutions to the problems of how to provide a convenient, compact, and yet adaptable, surge protector.

SUMMARY OF THE INVENTION

In order to solve the above described problems of longstanding in the art, a modular outlet strip or surge protector is provided where only the number and types of modules needed are purchased and connected easily together by quick connect means. Generally, the outlet strip or surge protector consists of a power distribution portion, which is connected to a source of line current, and one or more modules of a power supply type which snap to each other, and the power distribution module, by the use of quick connect means. This provides the needed functions without, at the same time, providing a large and bulky surge protector.

In one modification of the present invention, a power distribution module has a line cord having a standard and well-known three prong plug for connection to a source of line current. Connected to the line cord, seriatim, may be such as a circuit breaker, an on/off switch, an indicator light and a power transfer receptacle. A female portion of a quick connect means is also provided by which a power supply module having first and second power transfer connectors, and a male portion of the quick connect means is quickly snapped into place. The power supply modules may have as few as one power supply receptacle, or may have as many as desired. In the preferred embodiment of the present invention, the power supply modules come with either two or four power supply receptacles, and either have a female portion of a quick connect means on the other end to provide for connection of additional modules, or terminate with a modem surge protector having an RJ 11 connector in the end thereof.

In another modification of the present invention, the female portion of the quick connect means consists of an elongated slot at the base of a shroud, and the male portion of the quick connect means consists of an elongated ridge on a tab, said elongated ridge fitting into the slot in the female portion of the quick connect means.

In a third modification of the present invention, the quick connect means consists of a male portion comprising a shroud surrounding a male power transfer connector, and having an opening therein at a predetermined position, and of a predetermined shape, to accept a portion of a female quick connect means. The relevant portion of the female quick connect means comprises a female power transfer connector contained within a reduced housing portion and having a tab with a like shaped protuberance to said opening formed thereon.

Thus, it is an object of the present invention to provide a modular outlet strip or surge protector system.

It is a further object of the present invention to provide a modular outlet strip or surge protector having a power distribution module, and one or more types of power supply modules.

A still further object of the present invention is to provide a power distribution module in a modular surge protector having a line cord connected seriatim to a source of power, a circuit breaker, an indicator light and a switch, terminating in a female power transfer receptacle cooperating with the female portion of the quick connect means.

It is a further object of the present invention to provide a module for use in a modular surge protection system having a plurality of power supply receptacles formed in the top thereof, a male portion of a quick connect means formed on one end thereof, and a female portion of a quick connect means formed on the other end thereof.

A further object of the present invention is to provide a module for a modular surge protector system having modem surge protection means and power supply surge protection means provided in the same module.

A still further object of the present invention is to provide an outlet strip or surge protector of a modular nature providing for convenience to the user by being able to be assembled in various ways depending on the user's needs.

A still further object of the present invention is to provide a modular outlet strip or surge protector of the foregoing nature which is easy to manufacture and is of a low cost and economical nature.

Further objects and advantages of the present invention will be apparent from the following description and appended claims, reference being made to the accompanying drawings forming a part of the specification, wherein like reference characters designate corresponding parts in the several views.

It is to be understood that the present invention is not limited to the details of construction and arrangement of parts illustrated in the accompanying drawings, since the invention is capable of other embodiments, and is capable of being practiced or carried out in various ways within the scope of the claims. Also, it is to be understood that the phraseology and terminology employed herein is for the purpose of description, and not of limitation.

DETAILED DESCRIPTION OF THE PREFERRED EMBODIMENTS

Figure 1:
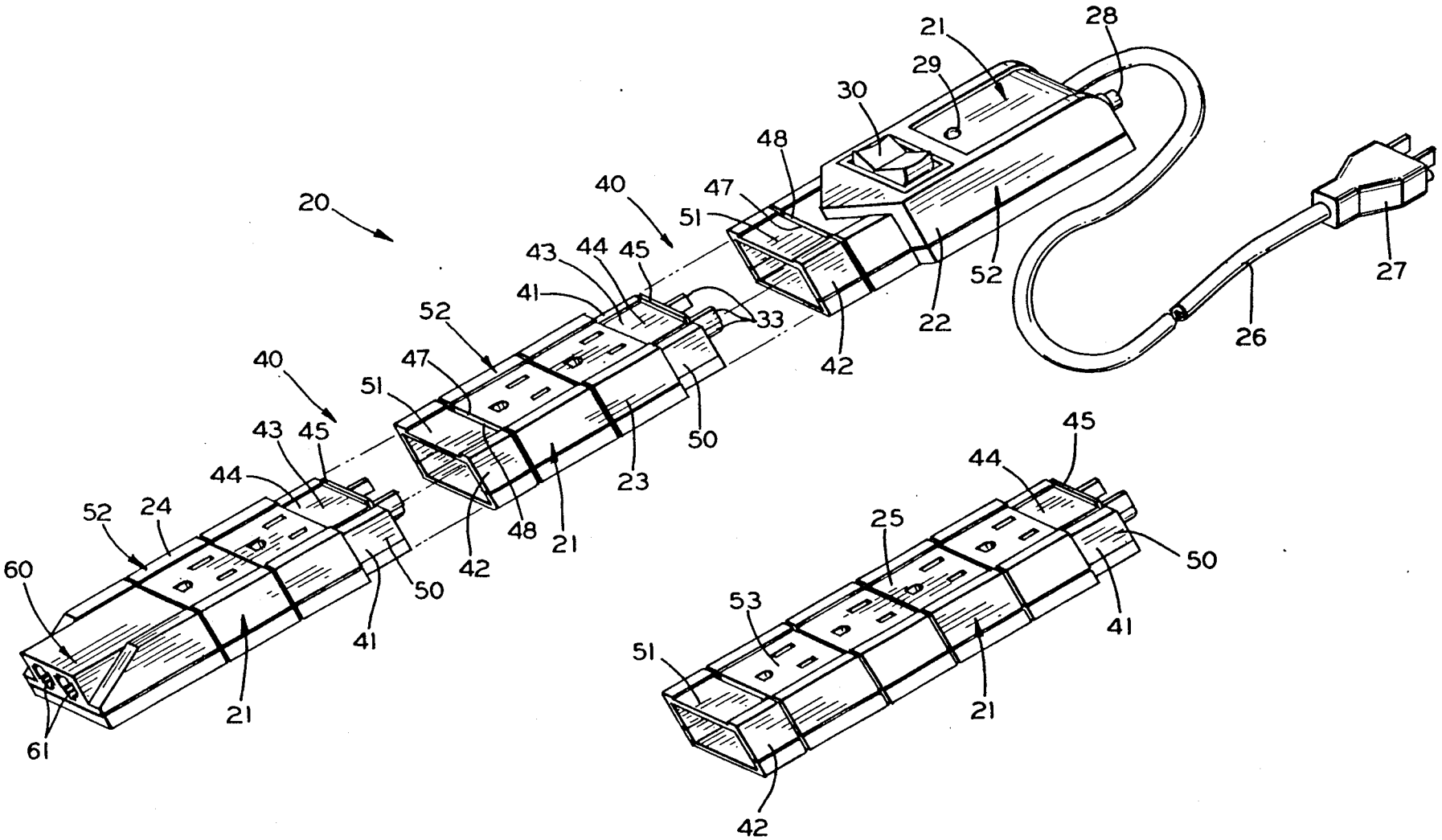
FIG. 1 is a perspective view of a modular surge protector of the present invention showing the different modules usable with the system of the present invention, and how they connect together.

Referring now to FIG. 1, there is shown an exploded perspective view of the modular surge protector of the present invention, generally designated by the numeral 20. The modular surge protector 20 consists of one or more modules 21, such as the power distribution module 22, the two receptacle module 23, the modem surge protector module 24, and the four receptacle module 25.

The power distribution module 22 typically has a line cord 26 terminating in a plug 27 for connection to a source of line current. The plug 27 may be a two-prong or three-prong plug or other plug as desired. For purposes of illustration, there is shown a standard, three conductor, polarized connector or grounding plug, although it is to be understood that whatever type of line current the surge protector is to be used on, will dictate the particular form of the plug.

Also found on the power distribution module 22 is a circuit breaker 28, an indicator light 29, and an on/off switch 30.

Figure 14:
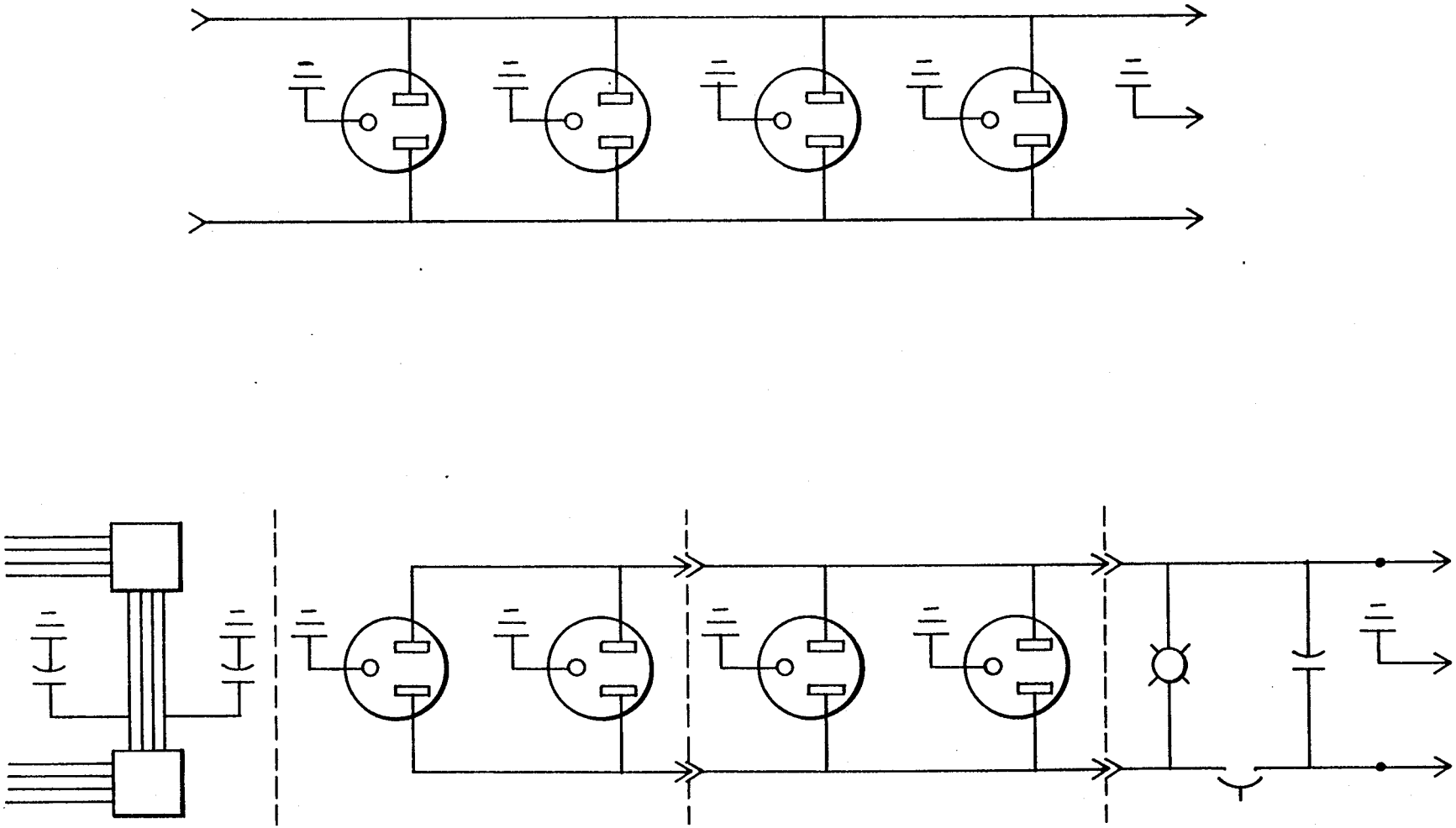
FIG. 14 is a electrical schematic of the construction shown in FIG. 1.

The line cord 26 is electrically connected seriatim to the circuit breaker 28 the indicator light 29 and the on/off switch 30 before terminating at the female power transfer connector or receptacle 31. The female receptacle 31 has a plurality of appropriately shaped receptors 32 to receive a plurality of like shaped male connectors 33 carried by the male power transfer connector 34. An electrical schematic of the power distribution module 22, two receptacle module 23, the modem surge protector module 24, and the four receptacle module 25 is shown in FIG. 14.

The various modules 21 of my improved surge protector are connected by quick connect means, generally designated by the numeral 40. Each of the quick connect means 40 contains a male portion 41 and a female portion 42. In the embodiment shown FIGS. 1, 2 and 6, the male portion 41 has a retainer means 43 in the form of a tab 44 having an upstanding ridge portion 45, while the female portion 42 of the quick connect means 40 has a retaining means 47 in the form of a slot 48 which receives and retains the upstanding ridge 45 provided on the tab 44 forming a portion of the male portion 41 of the quick connect means 40. As will be seen in the further embodiments of the invention shown in FIGS. 3, 7 and 8, the position of the retainer means 43 and the retaining means 47 can be reversed, and they can take forms other than tabs 44 which fit in slots 48.

Figure 2:
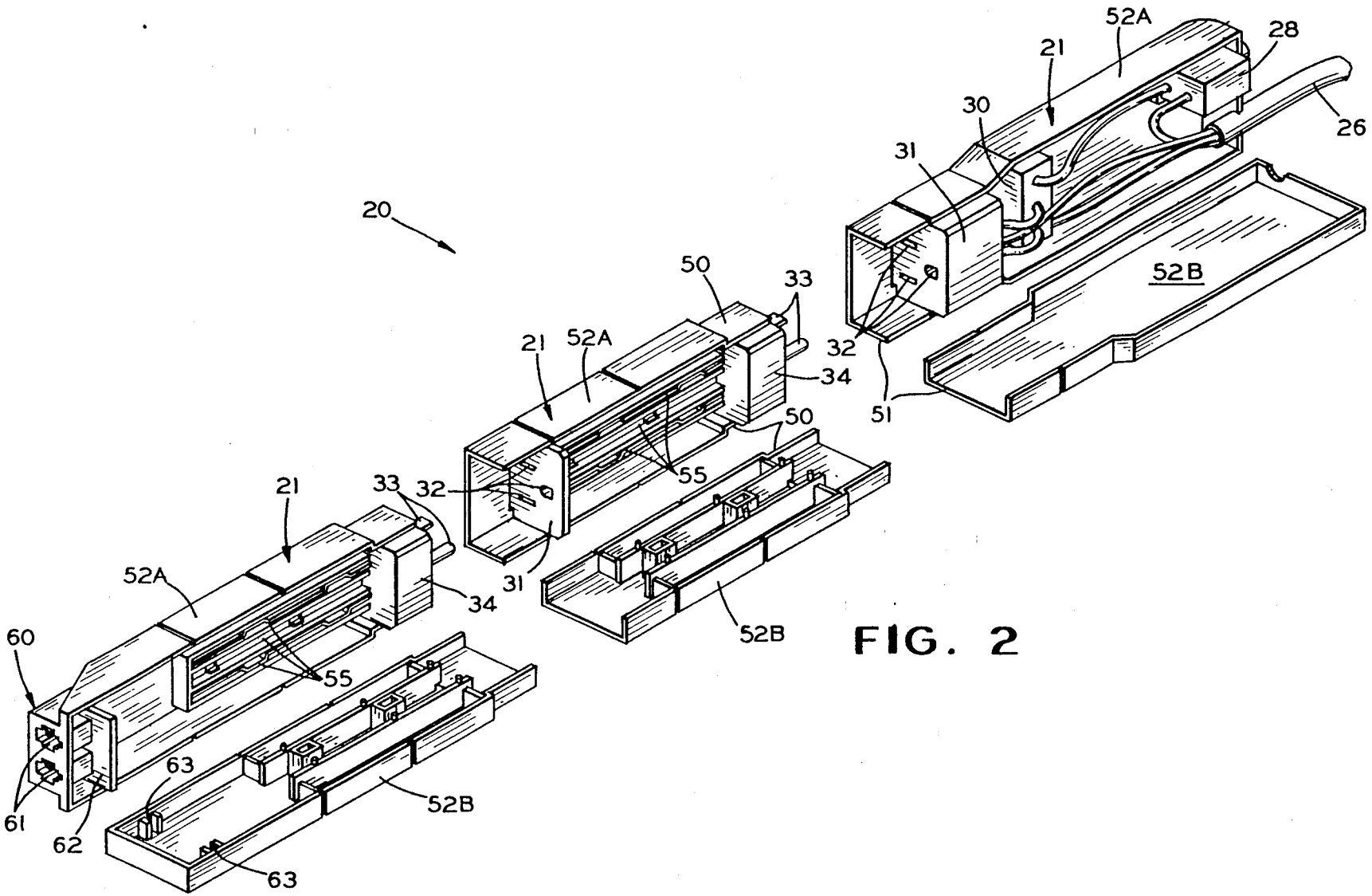
FIG. 2 is an exploded perspective view showing the interior construction of some of the modules shown in FIG. 1.

In the embodiment of the invention shown in FIGS. 1 and 2, the male portion 41 of the quick connect means 40 generally takes the form of a reduced housing portion 50 surrounding the male power transfer connector 34 (FIG. 2), while the female portion 42 of quick connect means 40 takes the form of a shroud 51 formed on the end of housing 52. The reduced housing portion 50 of the housing 52 plugs into and is surrounded by the shroud 51. Each module 21, except the power distribution module 22, contains one or more power supply receptacles 53 into which the power line cord of the equipment being protected is plugged into.

As can be seen, the live, earth, and ground female receptors in each female power transfer connector 31 are connected to the live, earth, and ground male connectors 33 in the male power transfer connector 34 by the live, earth, and ground connector strips 55 shown in FIG. 2. These are of a type well known in the art and need not be described in detail herein. The appropriate openings in the power supply receptacles 53 are in electrical communication with the appropriate ones of the live, earth, and ground connector strips 55 to properly supply power to the equipment plugged into the modules 21.

It is now possible by use of the improved modular surge protector of the present invention to provide a modem surge protector, generally designated by the numeral 60, as at least a portion of one of the modules 21. In this case, a standard RJ 11 connector 61 is provided at one end of the module 21, and is connected to printed circuit board 62 of a type well known in the art.

The circuit board 62 is retained within slots 63 provided in the housing.

It can be understood that in the embodiment of the invention shown in FIGS. 1 and 2, each housing 52, no matter what its particular shape, is divided into an upper portion 52*a* and a lower portion 52*b*. The upper housing portion 52*a* may be cemented, screwed or otherwise fastened to the lower housing portion 52*b*. In a further modification of the invention it will be shown how these housing portions can snap together.

Figure 5:
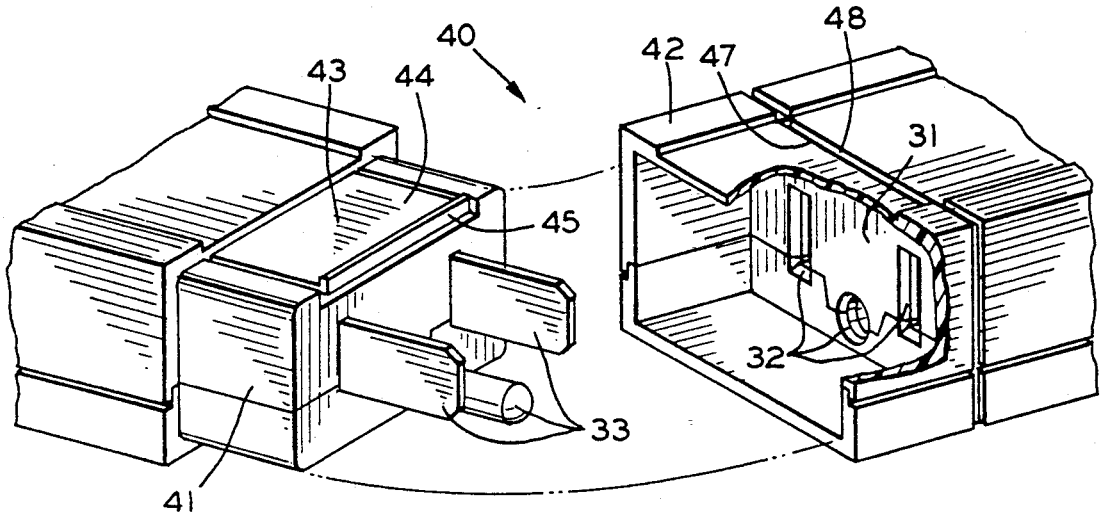
FIG. 5 is an enlarged view of the quick connect means shown in FIG. 1.
Figure 6:
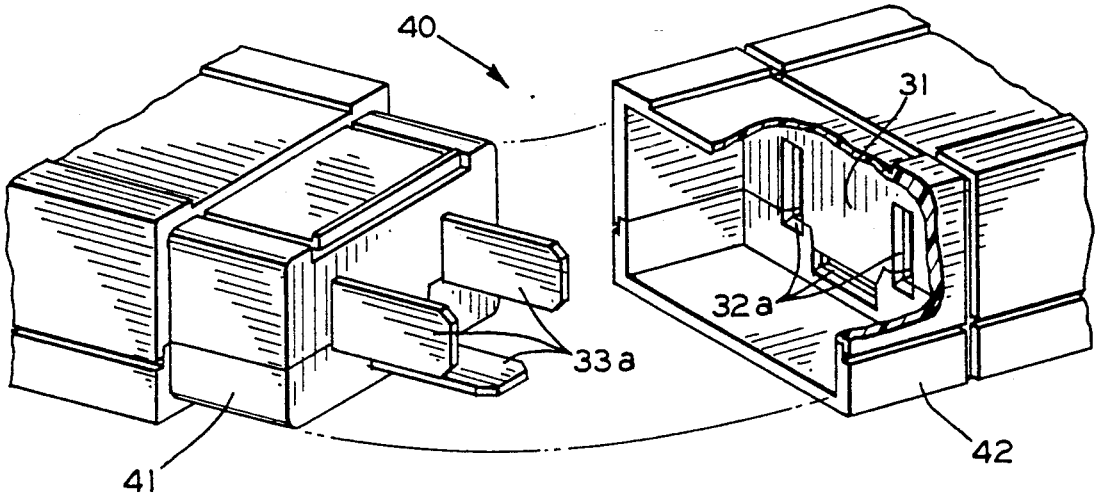
FIG. 6 is similar in part to FIG. 5, showing identical quick connect means, and showing a modified power transfer means.
Figure 7:
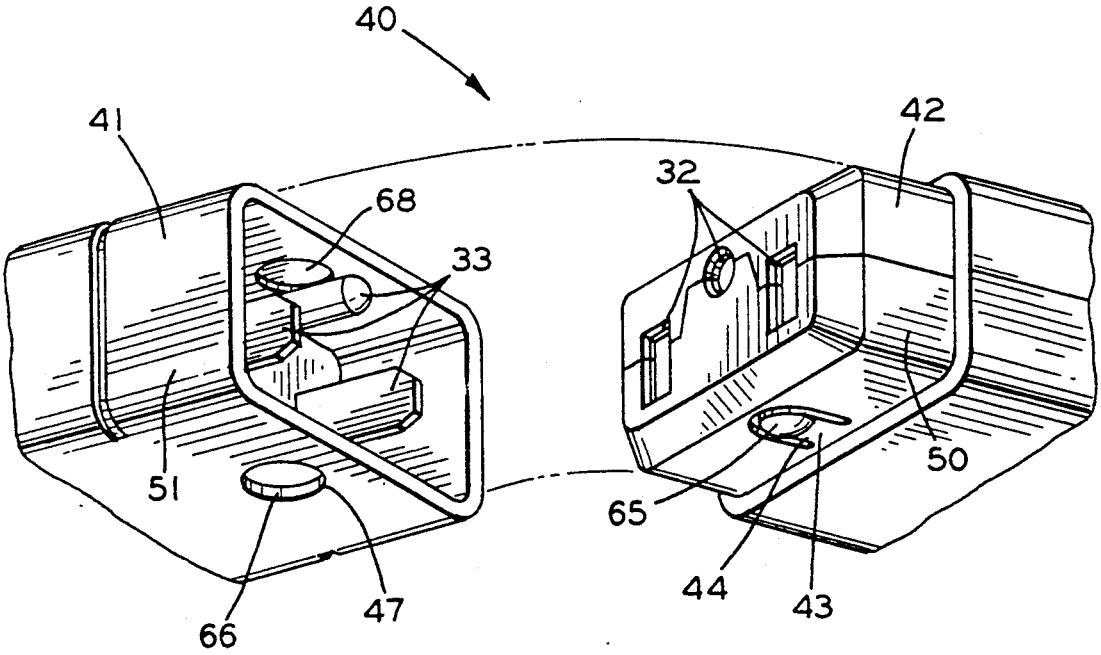
FIG. 7 is a view similar in part to FIG. 6, but showing a modification of the invention having a different quick connect means.

Referring now to FIG. 6, a modification of the invention shown in FIG. 5, is provided. The male portion 41 and the female portion 42 of the quick connect means 40 of the construction shown in FIG. 6 is exactly identical to the construction shown in FIG. 5. However, the female receptors 32 and the male connectors 33 shown in FIG. 5 have been modified in the construction shown in FIG. 6. FIG. 5 shows a standard three-prong grounding connector familiar to many consumers. However, in certain applications, it is anticipated that it will not be desirable to have a female power transfer receptacle 31 capable of receiving a standard three-prong connector, and the modification of the invention shown in FIG. 6 has the grounding portion of the male connectors modified to be a flat strip rather than the cylindrical type of grounding prong normally used. To differentiate the female receptors and the male connectors in this modification of the invention, they have been designated 32*a* and 33*a* respectively.

Figure 3:
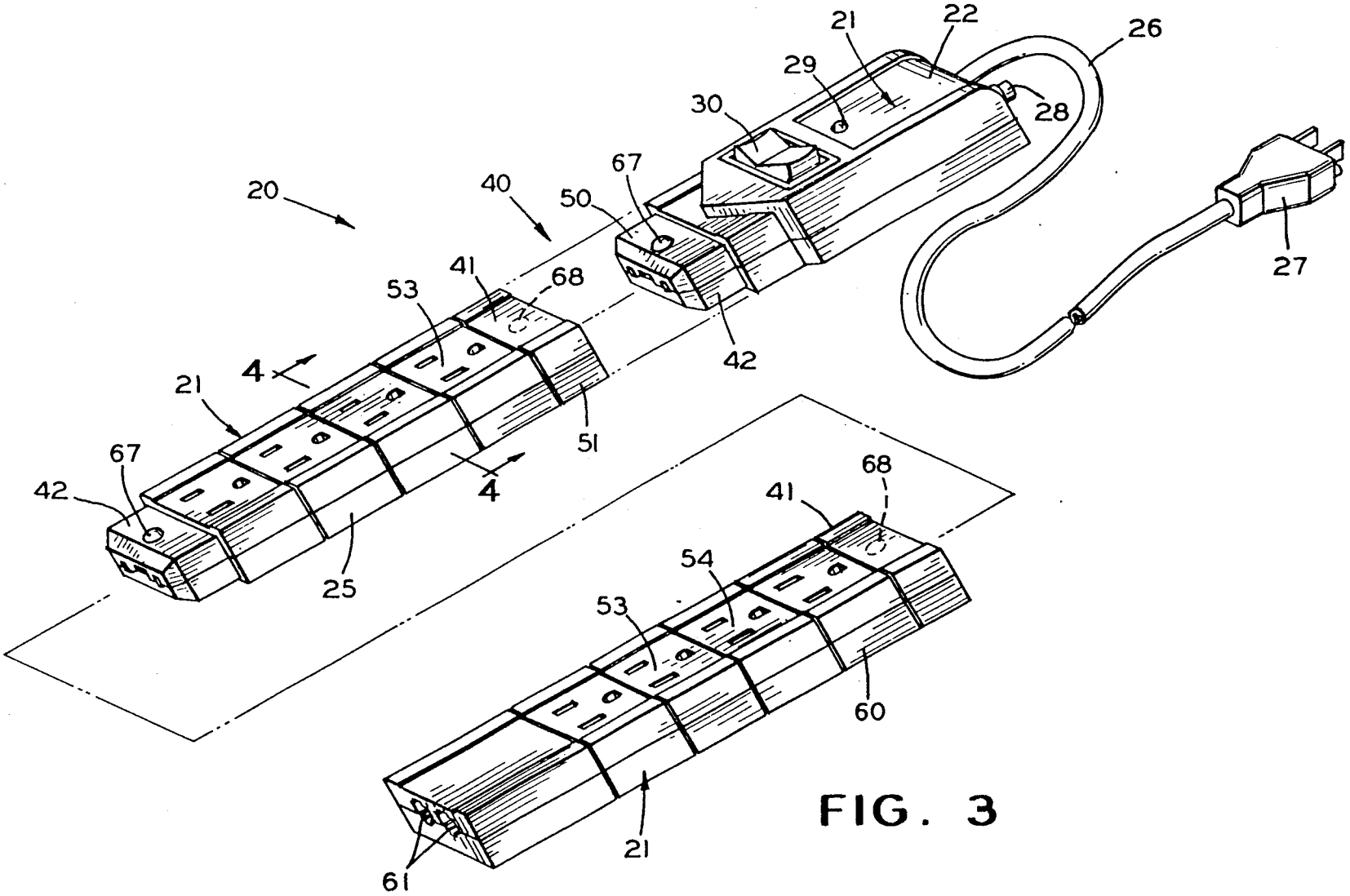
FIG. 3 is a perspective view, similar in part to FIG. 1, but showing a modification of the present invention having different quick connect means.

Referring now to FIGS. 3, 4, 7 and 8, a further modification of the present invention is shown. In this modification, the modular surge protector 20 also has a plurality of modules 21, such as the power distribution module 22, a four receptacle module 25, and a modem surge protector module 24. The power distribution module 24 is connected to a source of power with a line cord 26 terminating in a plug 27. As before, the line cord 26 is connected to a circuit breaker 28, an indicator light 29, and an on/off switch 30. However, several differences in the modification of the invention shown in FIG. 3 are also immediately apparent. In this modification, the modem surge protector module 60, having the RJ 11 connector 61 at the end thereof, has four power supply receptacles 53 instead of the two shown in the construction illustrated in FIG. 1. Also, it is to be noted that a different type of quick connect means 40 is provided which has essentially reversed some of the parts present in the construction of FIG. 1. While the male portion 41 and the female portion 42 still go together to form the quick connect means 40, the shroud 51 is now provided on the male portion 41 of the quick connect means 40, instead of on the female portion 42. The shroud 51 now completely covers the male connectors 33, which plug into the female receptors 32. The shroud 51 completely encloses the reduced housing portion 50.

In this embodiment of the invention, the retaining means 43 is in the form of a tab 44 formed integrally with the reduced housing portion 50 and having a protuberance 65 on the end thereof. The protuberance 65 fits in the opening 66 provided in the bottom of the shroud 51. It can be understood by one skilled in the art that the present invention has wide versatility as to the arrangement of the quick connect means. The modification of the invention just described has had not only the male and female portions of the quick connect means reversed, but the style and arrangement of the retainer means and retaining means.

Figure 8:
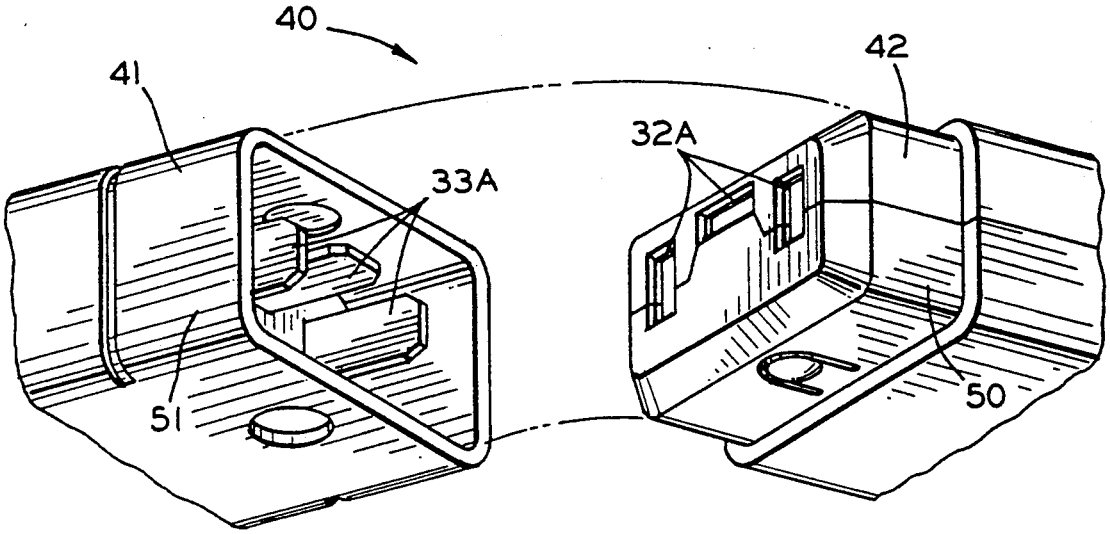
FIG. 8 is a view similar in part to FIG. 5, but showing a further modification of the invention having a different quick connect means.

To provide more stability to the invention, more than one retainer means 43 and retaining means 47 can be used. It can be seen that in FIGS. 3 and 7, the tab 43 and the opening 66 are provided in the bottom of the reduced housing portion 50 and shroud 51 respectively. Provided on the top of the reduced housing portion 50 in this modification of the invention, is dome 67 adapted to fit into circular recess 68 provided in the shroud 51. This gives the quick connect means additional stability. As with the modification of the invention described in FIG. 1, the modification of the invention illustrated in FIG. 3 can also have the version of the male connectors 33*a* shown in FIG. 6, as shown in FIG. 8.

Figure 4:
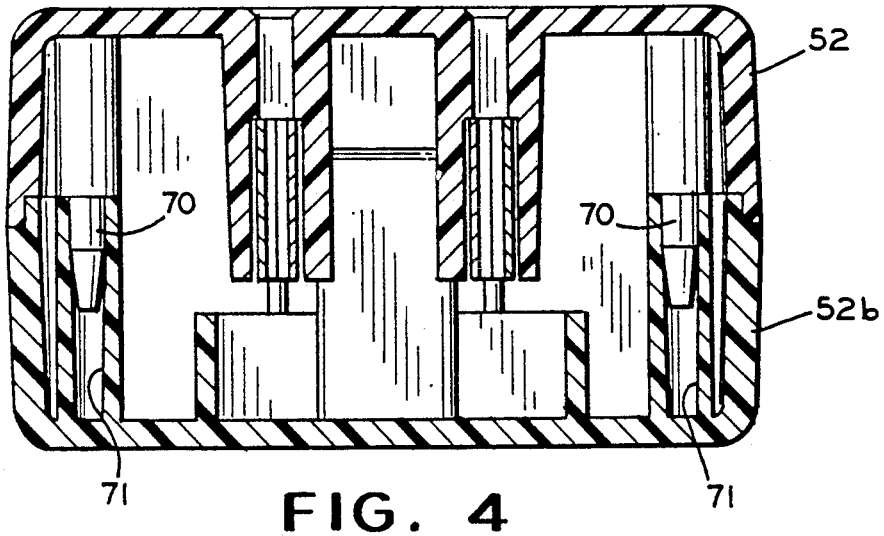
FIG. 4 is an sectional view, taken in the direction of the arrows, along the section line 4—4 of FIG. 3.

Referring now to FIG. 4, it can be seen how the upper housing portion 52*a* and the lower housing portion 52*b* "snap together." In contrast to the method of attaching the upper housing portion 52*a* and the lower housing portion 52*b* in the embodiment of the invention illustrated in FIGS. 1 and 2, in the modification of the invention illustrated in FIG. 3, a plurality of posts 70 are provided in the upper housing portion 52*a*, which fit into mating post holes 71 provided in lower housing portion 52*b*. The posts 70 are designed by means well known in the art to "snap" into the post holes 71, such that the two housing halves cannot be removed without being broken.

Figure 9:
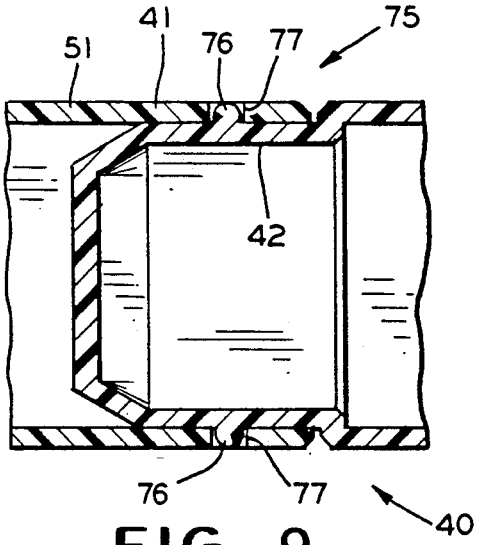
FIGS. 9–13 show several types of quick connect means which can be used with the present invention.

Referring now to FIGS. 9–13, the large variety of quick connect means 40, which can be used with the present invention, can be seen. In FIG. 9, there is shown a "snap-lock" quick connect means, generally indicated by the numeral 75 and having a pair of protuberances 76 extending through mating openings 77 to a point just even with the shroud 51. This "snap-lock" quick connect means 75 requires a tool for removal of the female portion 42 of the quick connect means 40.

Figure 10:
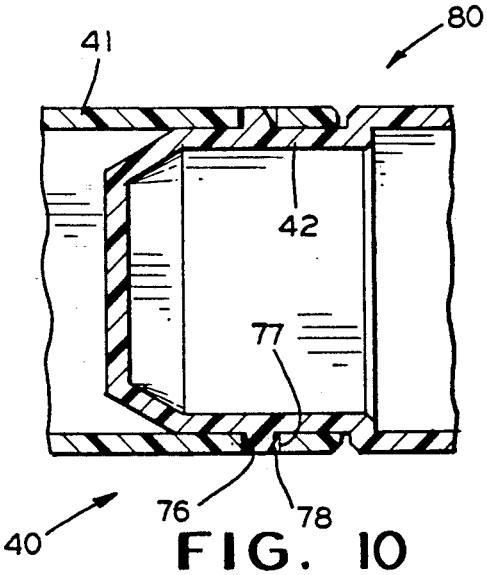

In FIG. 10, there is a modified "snap-lock" quick connect 80, wherein the protuberance 76, extending through the opening 77, has a tapered portion 78. Because of the tapered portion 78, the female portion 42 of the quick connect means 40 can be removed from the male portion 41 with a tool, or by the finger pressure of the operator.

Figure 11:
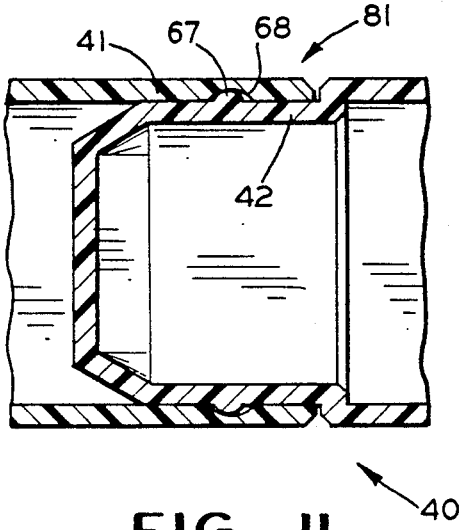

Referring now to FIG. 11, an internal snap quick connect 81 is provided, wherein a pair of domes 67 snap into an opposed pair of circular recesses 68 to complete the connection. This type of quick connect depends upon the flexibility of the particular material being used to make the connection between the male portion 41 and the female portion 42 of the quick connect.

Figure 12:
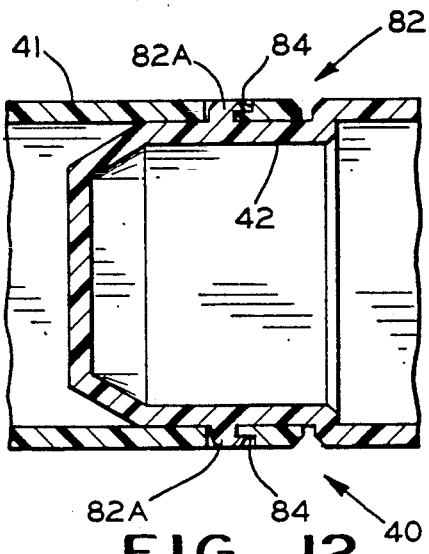

Referring now to FIG. 12, a locking type quick connect 82 is shown, wherein a pair of opposing fingers 82A provided on the female portion of the quick connect means fit into a pair of mating recesses 84 formed in the male portion 41. This lock type quick connect means is preferred when a permanent type connection is desired.

Figure 13:
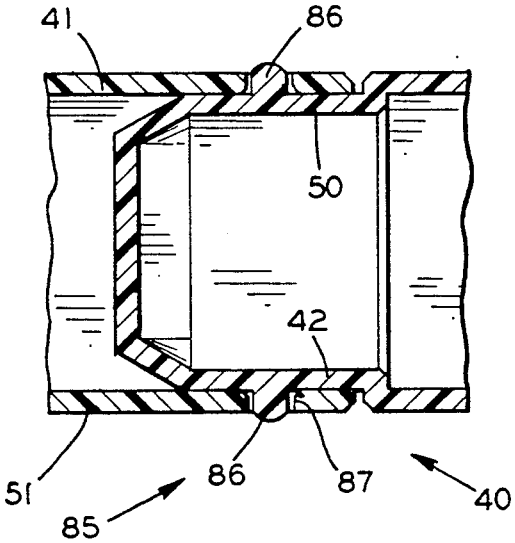

One of the easiest types of quick connects for the ordinary consumer to use is shown in FIG. 13 and is a true finger pressure removal quick connect 85. In this type of quick connect, a pair of opposing projections 86 are formed on the reduced housing portion 50 of the female portion 42 of the quick connect means 40. Since the opposing projections 86 extend past the outer wall of the shroud 51, it is easy for the operator to apply sufficient finger pressure to cause the projections 86 to move inwardly and release the female portion 42 of the quick connect means 40.

Thus, by carefully considering the problem of how to supply a surge protection means which will meet the needs of the greatest number of purchasers at a minimum expense and meeting that need by providing a modular type surge protector, whereby the equipment owner needs only to purchase those modules actually needed, I have provided a new and novel modular surge protector.

What is claimed is:

1. A surface-mounted modular outlet strip for delivering power from an electrical wall outlet, said modular outlet strip comprising:

a) a power cord having a first end connectable to the electrical wall outlet;

b) a power distribution means connected to a second end of said power cord, said power distribution means including a switch mounted in a first elongate housing and connected to a first quick connect means integrally formed at one end of the first elongate housing;

c) an outlet means removably connected to said power distribution means, said outlet means including a second quick connect means integrally formed as part of one end of a second elongate housing, and at least one electrical outlet connected in series to the second quick connect means and integrally formed in the second elongate housing, the second quick connect means removably connected to the first quick connect means in said power distribution means, and the first and second elongate housings each having a first longitudinal surface in coplanar relationship for engaging a surface and a second longitudinal surface in a coplanar relationship for positioning the switch and the electrical outlets, whereby power is selectively distributed from the wall outlet through said power cord and said power distribution means to the electrical outlets of said outlet means.

2. The modular outlet strip defined in claim 1 wherein the first quick connect means is a female connector and the second quick connect means is a male connector.

3. The modular outlet strip defined in claim 1 wherein the first quick connect means is a male connector and the second quick connect means is a female connector.

4. The modular outlet strip defined in claim 1 including a retention means for interlocking the first quick connect means in said power distribution means to the second quick connect means in said outlet means.

5. The modular outlet strip defined in claim 1 wherein the first elongate housing of said power distribution means includes a tubular shroud forming a part of the first quick connect means, said tubular shroud having an open end for receiving the second quick connect means, whereby the first quick connect means and the second quick connect means are removably connected within said shroud.

6. The modular outlet strip defined in claim 5 including a retention means for interlocking the first quick connect means in said power distribution means to the second quick connect means in said outlet means, said retention means including an aperture in said shroud and a corresponding protuberance on the second quick connect means.

7. The modular outlet strip defined in claim 1 wherein the second elongate housing of said outlet means includes a tubular shroud forming a part of the second quick connect means, said tubular shroud having an open end for receiving the first quick connect means, whereby the first quick connect means and the second quick connect means are removably connected within said shroud.

8. The modular outlet strip defined in claim 7 including a retention means for interlocking the first quick connect means in said power distribution means to the second quick connect means in said outlet means, said retention means including an aperture in said shroud and a corresponding protuberance on the first quick connect means.

9. The modular outlet strip defined in claim 1 including at least one outlet module removably connected in series between said power distribution means and said outlet means, said outlet module including an elongate housing segment provided with a third quick connect means at one end of the housing segment for engaging the first quick connect means of said power distribution means, at least one electrical outlet, and a fourth quick connect means at an opposite end of the housing segment for engaging the second quick connect means of the outlet means, said outlet module having the third quick connect means, the electrical outlet, and the fourth quick connect means integrally formed in the housing segment and connected in series, the housing segment having a first and second longitudinal surface in coplanar relationship with the longitudinal surfaces of the first and second housing, whereby power is distributed from the wall outlet through said power cord and said distribution means to the electrical outlets of said outlet module and said outlet means.

10. The modular outlet strip defined in claim 9 wherein said power distribution means includes a tubular shroud extending from the first elongate housing about the first quick connect means, and said outlet module includes a tubular shroud extending from the housing segment about the fourth quick connect means, both of said tubular shrouds having an open end for receiving a quick connect means, whereby the first quick connect means and the third quick connect means are removably connected in the power distribution means shroud, and the second quick connect means and the fourth quick connect means are removably connected in the outlet module shroud.

11. The modular outlet strip defined in claim 9 wherein said outlet means includes a tubular shroud extending from the second elongate housing adjacent the second quick connect means, and said outlet module includes a tubular shroud extending from the housing segment about the third quick connect means, both of said tubular shrouds having an open end for receiving a quick connect means, whereby the first quick connect means and the third quick connect means are removably connected in the outlet module shroud, and the second quick connect means and the fourth quick connect means are removably connected in the outlet means shroud.

12. The modular outlet strip defined in claim 1, wherein said outlet means includes a plurality of electrical outlets formed in the second planar surface of said outlet means.

13. The modular outlet strip defined in claim 9, wherein said outlet module includes a plurality of electrical outlets formed in the second planar surface of said outlet module.

14. The modular outlet strip defined in claim 9 wherein a plurality of said outlet modules are connected in series between said power distribution means and said outlet means.

15. The modular outlet strip defined in claim 1, wherein said outlet means includes at least one electrical outlet and a modem surge protector integrally formed in the housing of said outlet means.

16. The modular outlet strip defined in claim 15, wherein the modem surge protector includes an RJ 11 connector mounted in a surface of the second elongate housing of said outlet means and a circuit board mounted inside the housing.

17. A surface-mounted modular outlet strip for delivering power from an electrical wall outlet, said modular outlet strip comprising:

a) a power cord having a first end connectable to the electrical wall outlet;

b) a power distribution means connected to a second end of said power cord, said power distribution means including a switch mounted in a first elongate housing and connected to a female quick connect means integrally formed as part of one end of the first elongate housing;

c) a plurality of outlet modules, each of said outlet modules including an elongate housing segment having a male quick connect means at one end of the housing segment, at least one electrical outlet, and a female quick connect means at an opposite end of the housing segment, said outlet modules having the male quick connect means, the electrical outlet, and the female quick connect means integrally formed in the housing segment and connected in series, a first said outlet module having the male quick connect means removably connected to the female quick connect means of the power distribution means, and the remaining outlet modules removably connected in series to the first outlet module;

d) an outlet means removably connected to a final outlet module of said plurality of outlet modules, said outlet means including a male quick connect means at one end of a second elongate housing and at least one electrical outlet connected in series and integrally formed in the second housing, the male quick connect means of said outlet means removably connected to the female quick connect means of the final outlet module, and the first elongate housing, the housing segments and the second elongate housing each having a first longitudinal surface in coplanar relationship for engaging a surface and a second longitudinal surface in coplanar relationship for positioning the switch and the electrical outlets, whereby power is distributed from the wall outlet through said power cord and said power distribution means to the electrical outlets of said outlet modules and said outlet means; and e) a retention means for interlocking the female quick connect means of said power distribution means and said outlet modules to the male quick connect means of the adjacent outlet modules and said outlet means.

18. The modular outlet strip defined in claim 17 wherein a male quick connect means is substituted for the female quick connect means on said power distribution means, the female quick connect means of the first outlet module removably connected to the male quick connect of said distribution means, and a female quick connect means is substituted for the male quick connect means on said outlet means, the female quick connect of said outlet means removably connected to the male quick connect means on the final outlet module.

19. The modular outlet strip defined in claim 17 wherein said retention means includes a tubular shroud extending from the first elongate housing of said power distribution means and forming a part of the female quick connect means, and an identical tubular shroud extending from the housing segment of each of said outlet modules and forming a part of the female quick connect means, said tubular shrouds having an open end for receiving the male quick connect means, and said retention means also including an aperture formed in said tubular shrouds and a corresponding protuberance formed in the male quick connect means, whereby the first quick connect means and the second quick connect means are removably connected and interlocked within said shroud.

* * * * *